United States Patent [19]

Lubmann

[11] 4,148,156

[45] Apr. 10, 1979

[54] CATTLE RANCH GATE CONSTRUCTION

[76] Inventor: Elmont C. Lubmann, 4643 Fruitland Rd., Marysville, Calif. 95901

[21] Appl. No.: 931,483

[22] Filed: Aug. 7, 1978

[51] Int. Cl.[2] ..... E06B 11/00

[52] U.S. Cl. ..... 49/131

[58] Field of Search ..... 49/33, 131–134

[56] References Cited

U.S. PATENT DOCUMENTS

| | | | |
|---|---|---|---|
| 1,630,704 | 5/1927 | Kaiser | 49/131 |
| 1,653,716 | 12/1927 | Martin | 49/131 |
| 3,895,460 | 7/1975 | Lubmann | 49/131 |

FOREIGN PATENT DOCUMENTS

| | | | |
|---|---|---|---|
| 297120 | 8/1929 | United Kingdom | 49/131 |

*Primary Examiner*—Kenneth Downey
*Attorney, Agent, or Firm*—Lothrop & West

[57] ABSTRACT

A gate spanning a roadway presents an effective barrier to cattle and other livestock but tilts open in either direction of the roadway from closed, upright position to a horizontal position supported on the roadway surface under the force exerted by a motor vehicle nudged against the gate and driven over the gate in its horizontal position.

Counterweights connected to the gate by tension lines exert a restoring force urging the gate into upright position. The counterweights operate at an elevation well out of the way of people and vehicles and are provided with backup safety tether lines to prevent any harm in the unlikely event of failure of the tension lines.

4 Claims, 2 Drawing Figures

CATTLE RANCH GATE CONSTRUCTION

BACKGROUND OF THE INVENTION

The market place as well as the patent literature afford numerous examples of cattle ranch gates of the general type involved herein.

The gate disclosed in my U.S. Pat. No. 3,895,460 dated July 22, 1975, in fact, is one such example; and while my patented gate operates in a very satisfactory manner, I have found that in some environments and requirements of use, the counterweights, both while on the ground and while being elevated and lowered as a result of gate action, tend to get in the way and preclude freedom of movement by people and livestock in the vicinity of the weights.

There is, in other words, room for improvement.

SUMMARY OF THE INVENTION

The invention relates to a gate forming a part of a fencing system for cattle and other livestock. The gate is readily pivoted open by a vehicle pushing on the gate so as to rotate the gate from vertical to horizontal position. In closed position the gate provides an effective barrier to livestock.

The bottom of the gate includes a pivot pin spanning the distance between a pair of vertical posts on opposite sides of the roadway. Sets of counterweights connected to the gate by tension lines urge the gate toward upright, or closed, position.

The counterweights are in an elevated position at all times to permit the free movement of people and livestock under the counterweights. A safety line securely tethers the counterweights from falling should a tension line break.

DETAILED DESCRIPTION OF PREFERRED EMBODIMENT

Figures 1, 2:
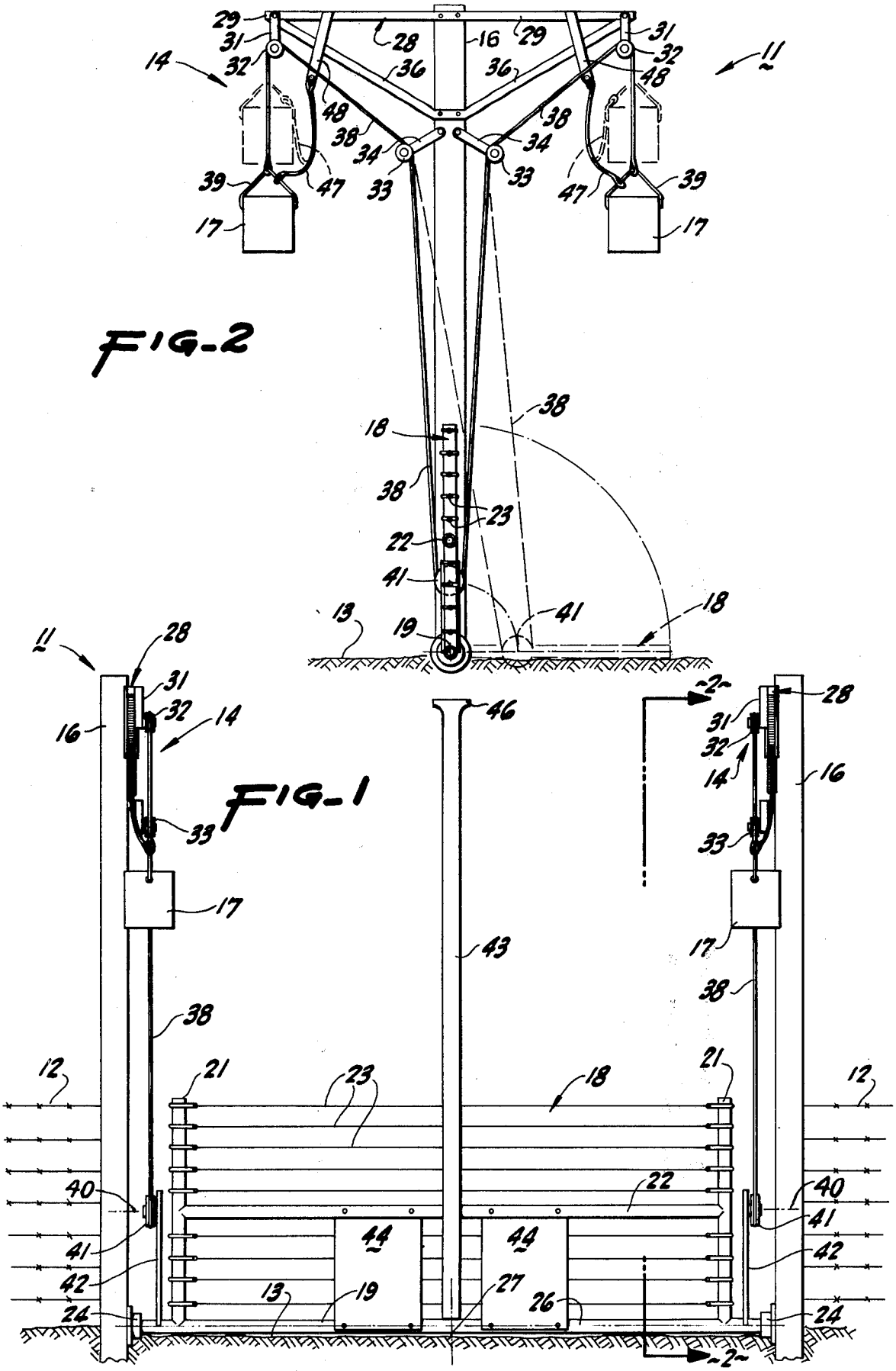
FIG. 1 is a front elevational view of a cattle ranch gate constructed pursuant to my invention; and, FIG. 2 is a sectional view taken on the line 2—2 in FIG. 1, the gate in closed, vertical position being shown in full line and in an open, horizontal position, in broken line.

The cattle ranch gate construction of the invention, generally designated by the reference numeral 11, customarily forms a part of the fencing 12 which segregates cattle and other livestock.

In order to maintain the integrity of the fencing system 12 where the fence is interrupted by a roadway 13, the gate 11 is provided. When in upright attitude, as most clearly appears in FIG. 1 in full line, the gate presents an effective barrier to escape by the cattle; when in horizontal attitude, as shown in broken line in FIG. 2, and opening is provided for the passage of a conveyance (not shown) traveling on the roadway 13.

Serving not only as an anchor for the fencing 12 but also as supports for a counterbalance structure 14 urging the gate into closed position, as will subsequently be explained in detail, is a pair of vertical posts 16 facing each other on opposite sides of the roadway 13. The posts 16 are securely anchored in the ground and are preferably on the order of ten to eleven feet high in order to provide adequate clearance for the counterweights 17 which are at all times in an elevated location to afford freedom of movement by people, livestock and vehicles underneath the counterweights.

The gate 11 includes a rectangular, panel-like frame 18 defined by a horizontal elongated pipe 19 on the bottom and a pair of vertical end pipes 21 upstanding from near the ends of the bottom pipe 19. To provide further rigidity, a horizontal stiffening pipe 22 extends between the end pipes 21 intermediate the top and bottom of the gate frame 18. Several horizontal wire cables 23 span the end pipes 21. The cables 23 are installed under tension and not only strengthen the gate frame but to a degree simulate the appearance of the fencing 12 and thus augment the barrier effect on livestock.

The bottom pipe 19 is elongated at opposite ends and serves as a pivot, being journaled in suitable bearings 24 mounted on the lower ends of the upright posts 16. Such construction enables the gate to pivot, or tilt, about a pivot axis 26, between the upright, closed position shown in FIGS. 1 and 2 and the horizontal, open position illustrated in broken line in FIG. 2.

It should be noted that while FIG. 2 shows the gate opened as would be caused by the passage of a conveyance along the roadway 13 from left to right, the gate can, with equal facility, be tilted in a counter-clockwise direction, as would appear in FIG. 2, by a vehicle moving from right to left.

The gate frame 18 is urged from the open, horizontal position toward the upright, or vertical position, by the counterbalance structure 14, including the two pairs of counterweights 17.

Since the gate construction is substantially symmetrical on each side of a vertical plane including the centerline 27 of the roadway 13, a description of one of the counterbalance structures 14 will serve equally to describe the other.

With particular reference to FIG. 2, a horizontal beam 28 is mounted symmetrically on the vertical post 16 adjacent the upper end thereof. The beam 28 is parallel to the centerline 27 of the roadway 13 and includes oppositely extending arms 29 on the ends of which are pivoted a pair of upper brackets 31 carrying a pair of rotatable upper pulleys 32.

Matching the upper pair of pulleys 32 is a pair of lower pulleys 33 rotatably mounted on lower brackets 34 pivoted on the post 16 at a location slightly below the point where struts 36 are secured to the post 16. The struts 36 extend angularly upwardly to join and help support the ends of the beam arms 29.

A continuous line 38, such as braided rope, is wound over the pairs of upper pulleys 32 and lower pulleys 33, as shown most clearly in FIG. 2. The ends of the line 38 are secured to bails 39 on the counterweights 17 and the bight of the line 38 is reeved about a sheave 41 mounted on the adjacent end of the gate frame 18 for rotation about an axis 40.

Conveniently, the sheave 41 is rotatably mounted on an arm 42 mounted vertically on the pivot pipe 19, as clearly appears in FIG. 1. The axis of rotation 40 of the sheave 41, furthermore is located at a distance well above the rotational axis 26 of the pivot pipe 19 so as to afford a substantial moment arm capable promptly of righting the open gate, i.e. making it possible for the lifting force caused by the counterweights 17 to apply a considerable torque tending to urge the horizontal gate promptly into vertical attitude.

The counterweights 17, in other words, put the line 38 in tension, with the line 38 exerting a constant upward force on the sheave 41.

This tension continues when a vehicle traveling along the roadway 13 slows down upon approaching the gate, then nudges the gate over to horizontal position by bearing against a tall central impact bar 43 mounted vertically on the pivot pipe 19 and the reinforcing pipe 22. Preferably, a pair of smooth vertical scuff plates 44 are also mounted on the gate, as shown most clearly in FIG. 1 to take any impact or wear from the vehicle's fenders or forwardly protruding tires. Thus, after the vehicle passes over the horizontal gate and clears the top 46 of the impact bar, the upward force exerted by the tensioned line 38 on the sheave 41, acting through the moment arm measured by the distance between the axis 40 of the sheave 41 and the axis 26 of the pivot pipe 19, causes the gate to be righted into closed position.

As can be seen in FIG. 2, the counterweights 17 are lifted from the static position shown in full line to the elevated position appearing in broken line as the supervening torque provided by the conveyance overturns the gate to open, horizontal position.

Even in static position, however, the counterweights 17 are located at a height exceeding that of the average person, being elevated, for example, to a height on the order of 6½ to 7 feet. By so doing, the movements of people, vehicles and animals are not interferred with in the vicinity of the counterweights.

In order to guard against even the slight risk of failure of the tension line 38, each of the counterweights 17 is secured to a slack tether line 47 of sturdy material, such as wire rope, secured at the lower end to the bail 39 and at the upper end to a bracket 48 fastened to the related arm 29 of the horizontal beam 28. Thus, if the tension line 38 should break the tether lines 47 would prevent the associated counterweights 17 from descending and possibly causing harm to someone or something below the counterweights.

It can therefore be seen that I have provided a cattle gate which is not only reliable and durable but which is also convenient in that the counterweights are safely up out of the way. In addition to being readily opened by vehicles of all types, the gate is also easily operated by the handicapped who may be riding, for example, in a relatively small conveyance, such as a wheel chair. At the same time, cattle and other livestock are successfully deterred from passing through the opening in the fence system.

I claim:

1. A cattle ranch gate construction for use on a roadway comprising:

a. a vertical pair of posts facing each other on opposite sides of the roadway;

b. a pair of beams each centrally mounted in a horizontal attitude on a respective one of said posts adjacent the upper end thereof, said beams being parallel to each other and to the direction of the roadway;

c. two pairs of upper pulleys, each of said pairs of upper pulleys being supported on the ends of a respective one of said beams in a predetermined plane parallel to the plane including said respective one of said beams;

d. two pairs of lower pulleys each of said pairs of said lower pulleys being mounted on a respective one of said posts and lying in the respective predetermined plane of the related one of said pairs of upper pulleys;

e. a gate frame transversely spanning the roadway, said gate frame being pivotally mounted on said pair of posts for movement about a horizontal axis transverse to and adjacent the surface of the roadway between a first upright position in the plane of said pair of posts and a second position substantially parallel to and in engagement with the surface of the roadway;

f. a pair of sheaves, each of said sheaves being mounted on the opposite ends of said gate frame below the respective pair of said pairs of lower pulleys and lying in the respective predetermined plane, the rotational axis of each of said sheaves being located well above the pivot axis of said gate frame to afford a substantial righting moment arm effective to urge said gate frame from said second position toward said first position when upward force is imposed on said sheave;

g. a pair of tension lines, each of said lines being trained around the bottom of a respective one of said sheaves, around the facing portions of a respective pair of lower pulleys and around the upper portions of a respective pair of upper pulleys with the ends of each of said pair of tension lines depending from the respective pair of upper pulleys; and, h. two pairs of counterweights, each of said pairs of counterweights being secured to the related depending ends of one of said pair of tension lines at a location well above the level of the roadway surface.

2. A gate construction as in claim 1 in which all of said counterweights are located at least six and a half feet above the level of the roadway surface.

3. A gate construction as in claim 1 including two pairs of backup tethers each of said pairs of tethers being mounted on the ends of the related one of said pairs of beams and connected with some slack to the respective one of said counterweights, each of said tethers being capable of supporting the respective one of said counterweights in the event of failure of the related one of said tension lines.

4. A gate construction as in claim 1 including impact means mounted on said gate frame for receiving from a vehicle on the roadway a pivoting effort overcoming the righting torque exerted by said counterweights.

* * * * *